United States Patent [19]

Vroome

[11] 4,071,250

[45] Jan. 31, 1978

[54] GOLF PRACTICE DRIVE ANALYZER

[76] Inventor: Ray L. Vroome, 43 Lawson Drive, Madison, Conn. 06443

[21] Appl. No.: 669,810

[22] Filed: Mar. 24, 1976

[51] Int. Cl.[2] ..... A63B 69/36

[52] U.S. Cl. ..... 273/185 C; 273/200 R; 273/198

[58] Field of Search ..... 273/200 R, 185 C, 184 B, 273/183 C, 95 A, 185 R, 185 A, 185 B, 185 D, 184 R, 184 A, 200 A, 200 B, 198

[56] References Cited

U.S. PATENT DOCUMENTS

| | | | |
|---|---|---|---|
| 914,873 | 3/1909 | Peter | 273/185 C |
| 1,672,395 | 6/1928 | Shinn et al. | 273/200 R |
| 1,982,808 | 12/1934 | Hendersen | 273/185 C |
| 2,032,081 | 2/1936 | Deane et al. | 273/200 R X |
| 3,298,232 | 1/1967 | Carboni | 273/184 B |

*Primary Examiner*—George J. Marlo
*Attorney, Agent, or Firm*—Roy L. Parsell

[57] ABSTRACT

A golf driving parctice device wherein a practice golf ball is anchored to a mat by a tether including first a chain including links of uniform length and weight secured to the mat and, second, a substantially weightless flexible cord connecting the chain to the ball. When driven by a golf club, the practice golf ball assumes a brief substantially unrestricted free flight which is gradually reduced in velocity by the uniformly weighted chain, and then comes to rest before all of the total length of the tether is used. The position and length of displaced tether laying on the mat being indicative of the direction and distance of the simulated flight.

4 Claims, 5 Drawing Figures

GOLF PRACTICE DRIVE ANALYZER

BACKGROUND OF THE INVENTION

Golf is played in many countries throughout the world and is a sport practiced and enjoyed by many persons in all classes of playing skills. Many players find enjoyment and beneficial practice in driving golf balls as exemplified by driving ranges, driving tees with net cages. Practice balls made of plastic or knitted yarns are used where flight distances are restricted. Also tethered practice balls are included in this latter category.

The current invention combines the advantages of many of the foregoing including full force and direction of each drive with a low cost of use and a minimum of space.

The device uses a golf ball driven from a practice tee in the usual manner but limited in its flight by a tether especially constructed to allow for a brief flight, then loss of velocity whereby the ball is brought to rest on the ground together with a length of tether displaced by the brief flight. The length of the tether adjacent its anchor end is of weighted material such as link chain while the remaining length of tether connected to the golf ball is of lightweight cord. The lightweight cord when of sufficient length and in a proper arc between the weighted portion and the tee prevents the head of the golf club from contacting the heavy part of the tether. The lightweight cord enables the ball to have a brief flight until the chain is picked up which gradually decreases the velocity of the golf ball so that it comes to rest on the ground also having displaced a portion of the chain. The length of displaced chain lying on the ground and its direction relative to the tee serves as a means to indicate distance and direction, upon proper calibration, thus simulating an actual drive.

DESCRIPTION OF THE PREFERRED EMBODIMENT

Figure 1:
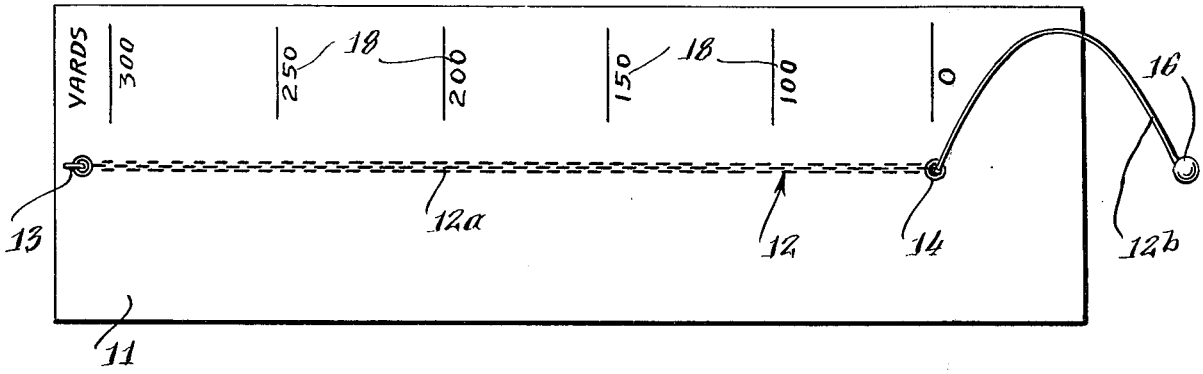
FIG. 1 is a plan view of the preferred embodiment of my invention.

Referring now to FIG. 1, numeral 11 denotes a plane surface which may be a mat, a board, grass plot or the like in which the surface, although plane, is rough enough so that the tether will lie in place both before and after driving and that it is not easily shifted by wind or an accidental contact with a moving body.

A tether 12 consists of a length of weighted flexible material such as link chain **12*a* and a lightweight material such as a nylon cord 12*b* which are connected together at respective ends. The unconnected end of the chain 12*a* is secured to an anchor 13 at one end of the plane surface and the unconnected end of the lightweight cord 12*b* is secured to the practice golf ball 16 poised on the golf tee 17 as shown also in FIG. 2** by broken lines.

The plane surface 11 may also be provided with a scale of indicia denoting distances of the simulated drives to be subsequently described in more detail. In this connection it is noted that the anchor is positioned as well as the plane surface in the general direction of the intended direction of the drive.

The procedure for using the practice device is described as follows. The player takes his stance and drives the tethered practice ball in the usual manner with the tether and the teed up ball 16 as shown in FIG. 1.

Figure 2:
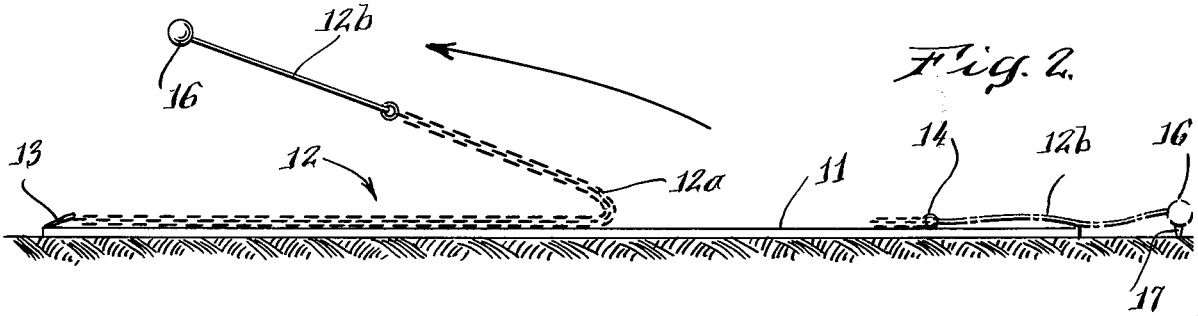
FIG. 2 is an elevation showing the tethered practice ball in flight.

The tethered ball 16 takes off as shown in FIG. 2. The lightweight cord **12*b* of the tether 12 enables the golf ball 16 to attain some altitude and distance in space before the heavier portion i.e., the chain 12*a* begins to affect the flight of the ball 16 and cause it to lose its velocity until it falls to the ground as shown in FIG. 3**.

Figure 3:
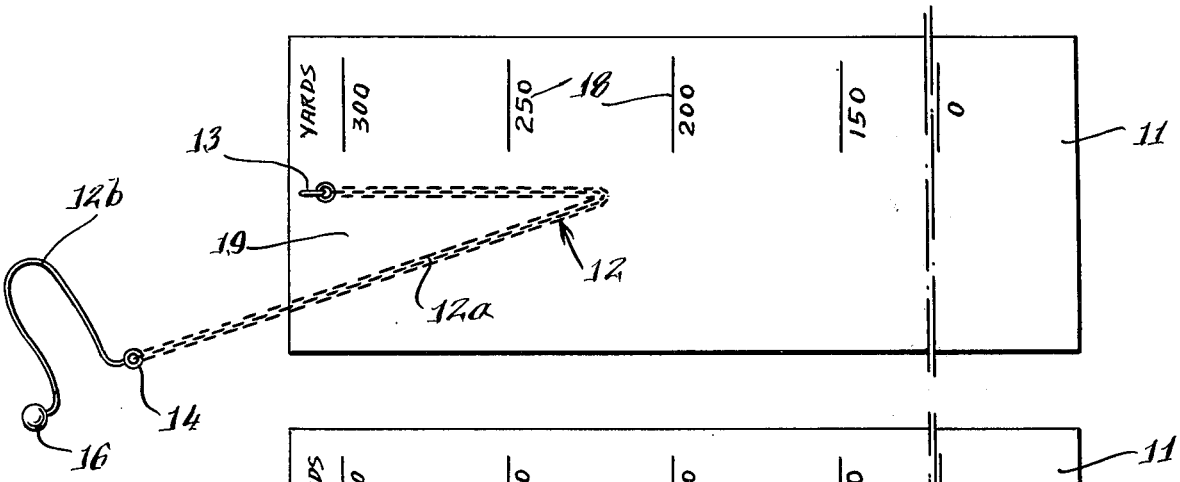
FIG. 3 is a plan view showing the practice ball and its tether reposing on the ground after a practice drive.

In the example shown in FIG. 3 the ball has been driven slightly to the left of the normal flight direction when it then falls to the ground with the chain portion **12*a*of the tether laying on the plane surface 11** and area adjacent thereto.

Still referring to FIG. 3 the amount of chain displaced can be used to determine the actual length of the simulated drive by experiment and calculation so that suitable indices may be established to enable a player, at a glance, to determine the distance of the simulated drive. The angle 19 between the displaced chain and the portion of the chain which is not disturbed indicates the direction of the drive with reference to the axis line extending between the position of the anchor 13 and the location of the practice tee 17.

Figure 4:
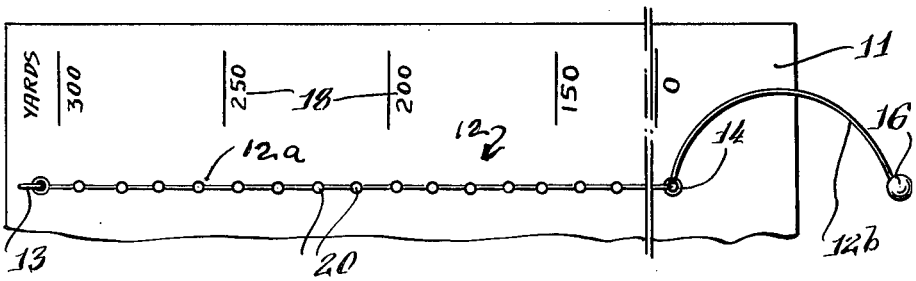
FIG. 4 shows another embodiment of the tether of my device.

The embodiment shown in FIG. 4 shows the weighted material portion **12*a* of the tether 12 to be a series of uniformly spaced weights 20**.

Figure 5:
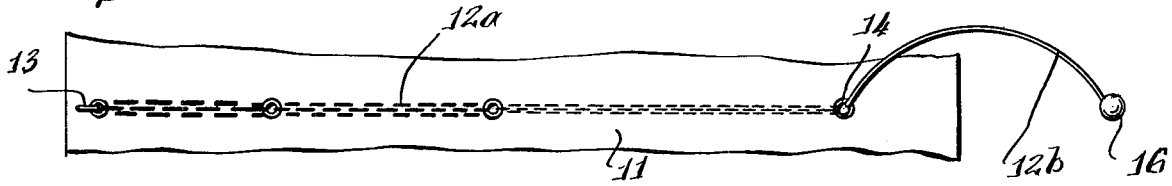
FIG. 5 shows still another embodiment in which the tether is composed of sections of different sized links.

Another embodiment is shown in FIG. 5 where different section lengths of chain are provided with various sized links, each section varying in respective weights from lightweight tether **12*b* end to the anchor 13 end of the tether. It will be obvious that depending on the weight of the respective sections nearest the anchor 13 that the decrease in velocity of the practice ball 16 might be more rapid as more weight decreases the velocity of the practice ball 16** in flight.

I claim:

1. A golf ball driving practice device comprising a. a practice mat having a first end and an opposite second end so that the mat may be disposed in the direction of the intended flight of the practice golf ball that is disposed adjacent the opposite second end;

b. a tether consisting of a first elongated flexible portion composed of uniformly distributed material heavy enough to gradually retard and bring to rest the practice golf ball when driven from a practice tee located adjacent the second end of the mat toward the first end of the mat and enable a substantial portion of the first portion of the tether to repose on the mat on termination of the flight; and c. a second elongated flexible portion composed of a lightweight cord connecting the practice golf ball to one end of the first portion of the tether whereby the practice golf ball may be teed at a safe distance from the end of the first portion of the tether and driven into a brief substantially unrestricted flight pattern before being gradually retarded by said uniformly heavy first portion.

2. The device according to claim 1 in which one end of the first portion of the tether is attached to the first end of the mat.

3. The device according to claim 1 wherein the first portion of the tether includes a chain composed of links of uniform length and weight.

4. The device according to claim 1 whereby the surface of the mat is marked with indicia for reading directly the distance of the simulated practice flight from the position of the displaced portion of the tether reposing on the mat after the flight has ended.

* * * * *